US005351886A

United States Patent [19]

Bull et al.

[11] Patent Number: 5,351,886

[45] Date of Patent: Oct. 4, 1994

[54] SELF-CLEANING SHOWER NOZZLE SYSTEM

[76] Inventors: Dan F. Bull, 191 Lehn Springs Dr.; Frank F. Bull, 130 Lafayette Blvd., both of Williamsville, N.Y. 14221

[21] Appl. No.: 16,318

[22] Filed: Feb. 11, 1993

[51] Int. Cl.[5] ..... B05B 15/02

[52] U.S. Cl. ..... 239/119; 239/112; 162/199; 162/275

[58] Field of Search ..... 239/104, 106, 112, 119; 162/199, 275

[56] References Cited

U.S. PATENT DOCUMENTS

| | | | |
|---|---|---|---|
| 460,368 | 9/1891 | Splittstoser | 239/DIG. 23 |
| 771,460 | 10/1904 | Clarkson | 239/112 |
| 3,073,529 | 1/1963 | Baker | 239/119 |
| 3,228,611 | 1/1966 | Russell | 239/112 |
| 4,148,668 | 4/1979 | Stewart, Jr. | 239/112 |
| 4,347,128 | 8/1982 | Barnscheidt | 239/119 |

FOREIGN PATENT DOCUMENTS

| | | | |
|---|---|---|---|
| 91/11266 | 8/1991 | PCT Int'l Appl. | 239/112 |

*Primary Examiner*—Karen B. Merritt

[57] ABSTRACT

A two piece non-moving nozzle assembly of which one piece includes an orifice with an internal extension acting as a solids barrier and the second piece providing channels for liquid and air passage. At a predetermined interval, air is automatically forced through the orifice in the opposite direction to liquid flow. When air is forced through the orifice, solids are removed.

3 Claims, 2 Drawing Sheets

SELF-CLEANING SHOWER NOZZLE SYSTEM

BACKGROUND OF THE INVENTION

I. Field of the Invention

The present invention relates to a self-cleaning shower nozzle system for use in the paper making industry. More specifically, the present invention allows for more effective use and recycling of white water for both high and low pressure fan and needle showers.

II. Prior Art

The paper making industry has for many years used fresh water in their showers with satisfactory results in both quality and cost of their paper. High and low pressure showers are required in the paper making industry to assure that the paper forming fabrics are lubricated and cleansed on a continuous basis. The quality of the paper is controlled by the smooth and clean travel of the forming fabrics through the paper machine. It is necessary that water is sprayed continuously on these fabrics, therefore ,shower plugging is a critical problem. Our self cleaning shower system eliminates this problem.

However, due to the ever-increasing costs of energy and mill effluent treatment, paper mills are recycling white water at an ever-increasing rate. (White water is a combination of fiber, chemicals, and water which forms the basic element of paper making.) The recycling of white water causes the showers on the paper machines to plug. This creates a need for an automatic, remotely operated, and safe method of self-cleaning.

In the past, attempts have been made to provide for a self cleaning shower nozzle. These attempts have been limited in success and in some cases caused further problems.

One approach to solving the problem of shower plugging is the use of an internal brush rotating inside the shower manifold. By either a back and forth or rotating motion, the brush moves over the nozzle orifice and wipes away any fiber or solids plugging the opening. This action supposedly removes any build up. Practically, however, the motion has a tendency to drive fiber or solids into the orifice rather then wiping away this build up. There are no apparent patents for this type of system although widely used in the paper industry. This system is supplied by various companies including Spraying Systems Co. of Illinois.

A second method involves a retracting piston which opens the orifice when internal manifold pressures are relieved or reduced. This allows a trickle of white water to flush the enlarged opening before closing when internal pressure is resumed. The problems in this method are twofold. One, when the pressure is low or off and white water is at a trickle, the build up of solids will not flush away. The piston, when pressurized, will jam on its return stroke and give a distorted nozzle spray pattern. Secondly, fibers have a tendency to plug moving parts in a short period of time, therefore limiting the effect of the piston motion. There are no apparent patents for this system and this system is of limited use in the paper industry. This system is supplied by various companies including Spraying Systems Co. of Illinois.

A variety of other water spray nozzles have been proposed, such as disclosed in U.S. Pat. No. 5,119,991 in which a nozzle assembly includes a sleeve, nozzle having an interior opening and slidable within the sleeve and a plunger that enters the interior opening of the nozzle. When the nozzle is slid within the sleeve, the plunger co-acts with the nozzle to clean any foreign substances present within the nozzle and remove a clog in the nozzle. The plunger, rather than remove debris, can further the problem by jamming fibers and solids into the orifice.

U.S. Pat. No. 2,117,647 in which a jet cleaning device is shown for a nozzle having an axially displaced plunger movable into the nozzle by the application of a force on the plunger. The force on the plunger opposes a biasing force applied by a spring that is interposed between the nozzle and the plunger. Cleaning of the nozzle is accomplished by first pushing the plunger into the nozzle and then rotating the plunger. Release of the force applied against the plunger causes the plunger to be withdrawn from the nozzle due to the biasing force of the spring. A disadvantage of this device is that cleaning involves a two step process of pushing the plunger within the nozzle and then rotating the plunger within the nozzle.

U.S. Pat. No. 3,474,968 discloses a self-cleaning nozzle that is axially movable into and out of the housing supporting the nozzle. The pressure of the fluid that is discharged from the nozzle controls the movement of the nozzle into and out of the housing. The nozzle is a generally hollow, cylindrical body having a sidewall defining one or more slits. The fluid to be discharged from the nozzle enters the nozzle through the slits and exits through an open end of the nozzle. A spider member, having projections that extend into the slits of the nozzle, is attached to the housing so as the nozzle moves into and out of the housing, any foreign substances that may be caught within the slits of the nozzle will be cleared.

While there are some merits to the approaches mentioned above, none fulfill the purposes of the present invention.

SUMMARY OF THE INVENTION

I. Brief Description of System

Our method of self-cleaning is accomplished by back flowing high pressure air through the nozzle orifice at automatically regulated time intervals. The remote mounted timing device turns off the white water flow through the nozzles as it turns on the back flow of air. At the end of this cycle of back flowing air, the timing device is programed to turn on the water flow and turn off the air flow. This sequence of on and off assures that any solids which can cause plugging are blown out of the orifice and into the manifold for ultimate draining. The timing cycle is kept short to maintain a clean opening and not allow the fibers or solids to become established. Shower systems are constantly under pressure and fiber and solids can force their way into any opening and get further lodged. The longer pressure is maintained the more firmly the fiber and solids get lodged in the orifice. This system is usable in fan and needle showers both high and low pressure.

Itemized Parts Description

Figure 1A:
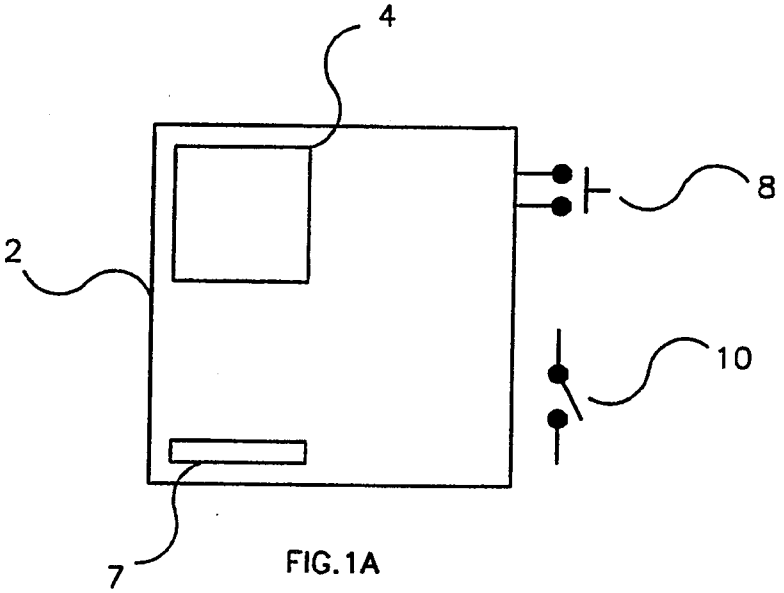
FIG. 1A. Schematic view of the content and make up of remote automation enclosure.
Figure 1B:
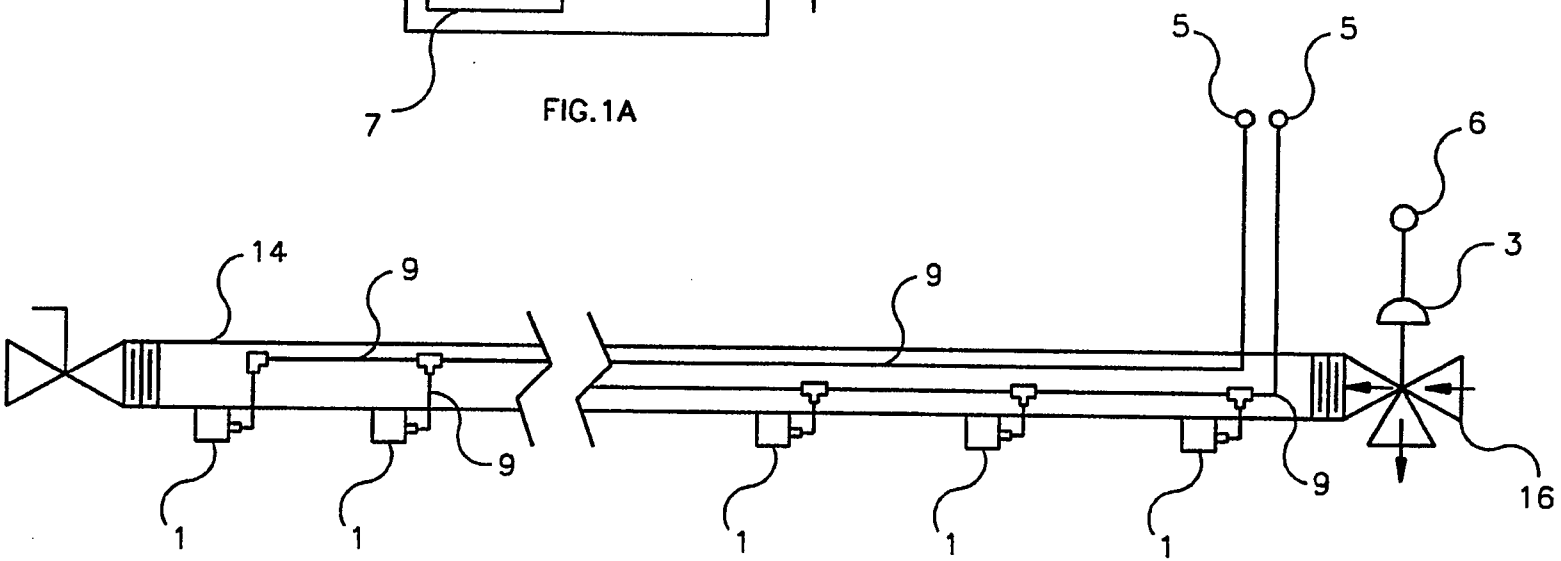
FIG. 1B. Fragmentary overall view showing relative positions of various components.
Figure 2:
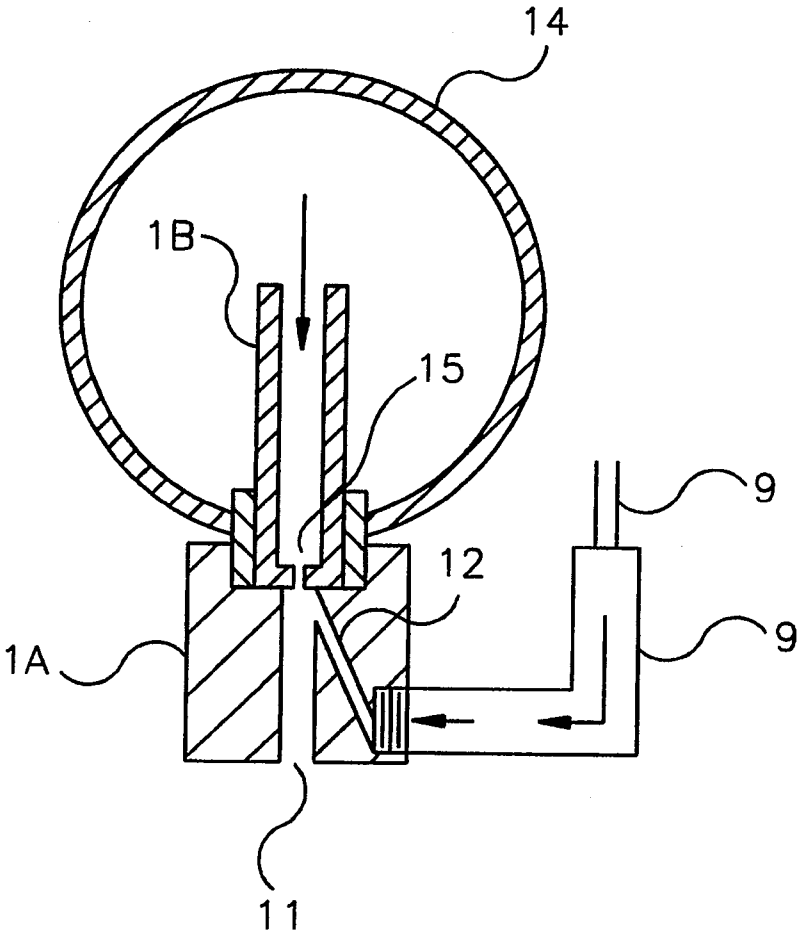
FIG. 2: Cross section view of shower nozzle and manifold assembly.

I. Self-cleaning Nozzle—Depending on application (Fan or Needle Spray) the self-cleaning nozzle (1) consists of two pieces and includes internal sleeve (1B), shower nozzle head (1A), orifice (15), reverse airflow channel (12), and outlet channel (11).

II. Air System—Air tubing to each nozzle is required for reverse airflow action. The air tubing is connected to an air source by either metal or plastic tubing. Various parts make up the air supply assembly and are comprised of air tubing, tube connectors, and hose (9).

III. Remote Automation System—Remote automation system consists of an electrical enclosure (2) suitable for watertight service. Interior items include programmable controller {PLC} (4) for time management, interconnecting wiring, terminal strip (7), air solenoid valves (5) for ON/OFF air control, exterior manual override push button (8), and external manual ON/OFF switch (10). The programmable controller {PLC} (4) and electrical enclosure (2) are of sufficient size and capacity to allow for expansion and can be used with multiple shower manifolds (14).

IV. Three Directional Inlet/Drain Valve—The inlet/drain valve (16) is provided for proper feed and drain of the system manifold (14). The valve is controlled from the remote automation enclosure (2), air operator (3), and solenoid (6).

| BILL OF MATERIAL | |
|---|---|
| I. Self-Cleaning Nozzles: | 1 to 100 nozzles per shower manifold. |
| II. Air Tubing: | .125" to 1" in diameter. |
| III. Construction: | Stainless steel, brass, or plastic. |
| IV. Orifices: | .016" to .3" in diameter. |
| V. Manifolds: | 1" to 8" in diameter. |
| VI. Operating Pressures | 0 PSI to 500 PSI |
| VII. Electrical: | Single Phase/60 Hertz/ 115/120 Volts. |

DETAILED OPERATING DESCRIPTION

The self-cleaning process is initiated by a time step in the programmable controller {PLC} (4) mounted in the remote automation enclosure (2). At a specific time interval and at repeating time intervals thereafter, the three-way inlet/drain valve (16) is automatically turned from feed to drain. The air solenoid valves (5) open to direct air into the air tubing (9) and to the reverse flow channel (12). The manifold (14) is draining at this point and thereby allowing the air through the reverse air channel (12), through the orifice (15), and into the manifold (14). This action purges the orifice (15) of any fiber and solids build up and also forces liquid out of the manifold (14). Materials that have been settling in the manifold (14) are also flushed out of the system during this step.

The airflow is on for a specific period of time as determined by experience and field trials during startup. This time interval is programed into the programmable controller {PLC} (4). At the end of the airflow step, the air solenoid valves (5) close, the three way inlet/drain valve (16) returns to liquid feed. The system is now on stream and ready for the next predetermined cleaning step. This self-cleaning procedure is constantly repeated until the system is manually shut off by the ON/OFF switch (10) at the remote automation enclosure (2). The manual override push button (8) is used to determine if the system is in working order. By pushing the manual override push button (8), the cleaning cycle will run through its predetermined steps as stated above from the programmable controller {PLC} (4). The manual override push button (8) can be used to clean the system between automatic cleaning steps if required.

We claim:

1. A nozzle system for use in the paper making industry comprising:
   - a manifold having at least one opening through a wall thereof;
   - a white water supply means connected to said manifold;
   - each said at least one opening of said manifold having a nozzle assembly connected thereto;
   - each said nozzle assembly including:
     - an internal sleeve which extends through a corresponding said at least one opening into said manifold, said internal sleeve having a passageway therethrough;
     - a shower nozzle head located external of said manifold and having an outlet channel and a reverse airflow channel therein;
     - said passageway of said internal sleeve communicating with said outlet channel and said reverse airflow channel through an orifice located at one end of said passageway of said internal sleeve;
   - air supply means connected to an end of said reverse airflow channel farthest from said orifice.

2. A method of spraying white water from a nozzle system and cleaning said nozzle system comprising:
   - initiating a fluid flow cycle by initiating a white water flow by directing white water from a white water supply means into a manifold;
   - directing said white water into a passageway of an internal sleeve which extends substantially into said manifold through an opening in a wall of said manifold;
   - directing said white water through an orifice located at a downstream end of said passageway, and into and through an outlet channel of a shower nozzle head located external of said manifold thereby spraying said white water;
   - turning off the flow of white water;
   - initiating a pressurized air flow by directing pressurized air from an air supply means to one end of a reverse air channel located in said shower nozzle head;
   - directing said pressurized air through said reverse air channel, through said orifice, through said passageway, and into said manifold, thereby purging said orifice of any foreign substances;
   - ending said fluid flow cycle by turning off the flow of pressurized air;
   - initiating another fluid flow cycle by resuming the flow of white water.

3. The method of claim 2 wherein the steps of initiating a fluid flow cycle, ending said fluid flow cycle, and initiating another fluid flow cycle are controlled automatically on a scheduled timed basis using a programmable controller.

* * * * *